US005370251A

United States Patent [19]

Buono

[11] Patent Number: 5,370,251

[45] Date of Patent: Dec. 6, 1994

[54] CHILD-RESISTANT CLOSURE

[75] Inventor: Caetano Buono, Staten Island, N.Y.

[73] Assignee: Van Blarcom Closures, Incorporated, Brooklyn, N.Y.

[21] Appl. No.: 96,036

[22] Filed: Jul. 22, 1993

[51] Int. Cl.[5] ..... B65D 50/02

[52] U.S. Cl. ..... 215/220; 215/230

[58] Field of Search ..... 215/220, 230, 206; 116/308; 206/534

[56] References Cited

U.S. PATENT DOCUMENTS

| | | | |
|---|---|---|---|
| 3,692,199 | 9/1972 | Mumford . | |
| 3,795,338 | 3/1974 | Swartzbaugh et al. . | |
| 3,797,688 | 3/1974 | Porcelli et al. . | |
| 3,968,894 | 7/1976 | Herrmann . | |
| 4,165,813 | 8/1979 | Babiol . | |
| 4,402,416 | 9/1983 | Mumford et al. . | |
| 4,520,938 | 6/1985 | Finke . | |
| 5,005,718 | 4/1991 | Buono | 215/220 |
| 5,020,681 | 6/1991 | Kusz | 215/220 |
| 5,092,477 | 3/1992 | Johnson, Jr. et al. | 215/220 |
| 5,115,929 | 5/1992 | Buono | 215/220 |
| 5,188,251 | 2/1993 | Kusz | 215/220 |
| 5,197,616 | 3/1993 | Buono | 215/220 |

*Primary Examiner*—Joseph Man-Fu Moy

*Attorney, Agent, or Firm*—Cohen, Pontani, Lieberman, Pavane

[57] ABSTRACT

An child-resistant closure for bottles and similar containers is provided. This child-resistant closure is provided with an inner cap which has a plurality of triangular saw tooth projections located on its outer surface and an outer cap which fits over and rotates relative to the inner cap and is provided with knurlings located on its inner surface. The knurlings of the outer cap are complementary to and angled the same way as the saw tooth projections of the inner cap so that when the outer cap is rotated in the opening direction, the knurlings will move freely or ratchet over the saw tooth projections. However, when axial force is applied to the outer cap toward the inner cap, the knurlings cam against the saw toothed projections causing the caps to rotate in unison and disengage from the container. Additionally, this child-resistant closure utilizes a guide on the inner surface of the outer cap to keep the inner cap in alignment with the outer cap.

18 Claims, 2 Drawing Sheets

CHILD-RESISTANT CLOSURE

FIELD OF THE INVENTION

This invention relates generally to a child-resistant screw-on closure for use on a container, the closure including relatively rotatable components uniquely designed to require less torque for their removal as a unit while still retaining the child-resistant safety feature.

BACKGROUND OF THE INVENTION

The present invention is directed to a child-resistant closure designed to require less torque for removal by an adult without sacrificing the child resistance safety feature incorporated into the closure.

Specifically, the inventive child-resistant closure device of the present invention includes an inner cap having a top and a cylindrical skirt depending from the top. The cylindrical skirt has both an outer surface and inner surface, with the inner surface of the skirt being threaded for threading engagement with the container when the inner cap is rotated in one direction. Conversely, the inner cap is disengageable from the container when the inner cap is rotated in an opposite direction. The outer cap is also provided with a top and a cylindrical skirt coaxial with and surrounding the skirt of the inner cap. The cylindrical skirt has an outer and inner surface with the inner and outer caps being in close confronting relation as well as being axially movable relative to one another.

Additionally, the inner surface of the skirt of the outer cap is provided with a plurality of knurlings which extend in an angular direction from the top of the outer cap. As well, the outer surface of the skirt of the inner cap is provided with a radial shoulder which is spaced dependingly downward from the top and which extends outwardly from the skirt of the inner cap. The radial shoulder is provided with a plurality of triangular saw toothed projections complimentary to the plurality of knurlings so that when the outer cap is turned in one direction, the plurality of knurlings and the plurality of triangular saw tooth projections will meet to cam the outer cap relative to the inner cap to rotate the inner cap in one direction thereby threadedly engaging the inner cap to the container. When the outer cap is rotated in an opposite direction, the plurality of knurlings will ratchet over the plurality of triangular saw tooth projections so that the rotation of the inner cap in the opposite direction to open the container is prevented. By applying an axial force to the outer cap and toward the inner cap, this enables the outer cap to impart rotation to the inner cap in the opposite direction. Accordingly, by applying this axial force, the ratcheting of the outer cap axially away from the inner cap is thereby prevented. Thus, a child-resistant screw-on closure, which, requires less torque for the removal of the closure device while still retaining the child-resistant safety feature is provided.

Child-resistant closures having relatively rotatable inner and outer components are known. However, prior art structures and arrangements have suffered from a variety of drawbacks and deficiencies. Typically, the inner component is adapted to be threaded onto and off the container with the outer component being constructed and arranged so that the two components must be manipulated in a particular fashion in order to remove the closure rather than merely rotating the part that is grasped. As such, two manipulations are required to remove the closure, i.e., the outer component must first be pushed down toward the inner component prior to rotating it in order to effect opening of the container for access to the contents. Although studies have proven this dual manipulation to be the most difficult for a child to execute in order to successfully remove the closure without special instructions, this safety locking feature becomes an annoyance to other members of the household. The elderly, in particular, often find the manipulations required to open the container bothersome.

Additionally, Kinsley U.S. Pat. No. 4,364,484 discloses a two piece child resistant closure formed from an integrally molded assembly. The integrally molded closure portion is connected to a collar portion by a web. The collar portion defines a recess to receive a closure clutch ring having a greater diameter than the recess defining portions of the collar portion thereby retaining the closure and collar portions in assembled relationship. The clutch ring defines teeth on its upper surface and the collar portions define complimentary downwardly forcing teeth. This child-resistant closure, however, does not provide a two-piece child-resistant screw-on closure having an inner cap and an outer cap, with the outer surface of the inner cap being provided with a saw toothed radial shoulder spaced dependingly downward from the top.

Scuderi U.S. Pat. No. 3,946,890 discloses a child-proof closure for containers having a threaded neck. A screw type cap is provided with a first set of teeth mounted on its side, with the teeth being set at an angle to the axis of the cap. A drive member is loosely mounted on the cap for limited axial motion. A second set of teeth is mounted on the drive member, the teeth being angled in the same direction as the first set of teeth. When the drive member is turned in the direction to remove the cap, the interaction of the teeth lifts the drive member relative to the cap so that the first and second sets of teeth disengage. Accordingly, the cap cannot be removed solely by turning. However, this arrangement does not provide the most efficient and effective construction, as this closure device requires a high degree of torque for its removal from the container neck.

None of the prior art teaches or suggests a child-resistant closure for use with a container having the outer surface of the skirt of the inner cap being provided with a radial shoulder spaced dependingly downward from the top and extending outwardly from the skirt of the inner cap. Moreover, no other prior art reference discloses such an inner cap having a radial shoulder being provided with a plurality of triangular saw tooth projections complimentary to the plurality of knurlings so that when the outer cap is turned in one direction, the plurality of knurlings and the plurality of triangular saw tooth projections will meet to cam the outer cap relative to the inner cap to rotate the inner cap in one direction to threadingly engage the inner cap on the container.

It is, therefore, an object of the present invention to provide a child-resistant closure that require less torque for its removal from a container by an adult, particularly, an elderly adult.

Another object of the invention is to provide an child-resistant closure that will be difficult for removal by a child.

A further object of the invention is to provide such a child-resistant closure having knurlings on the outer cap for engagement with corresponding projections on the inner cap to permit disengagement of the closure from the container.

Still other objects and advantages of the invention will in part be obvious and will in part be apparent from the specification.

SUMMARY OF THE INVENTION

Generally speaking, in accordance with the invention, a child-resistant screw-on closure for bottles and similar containers is provided. The inventive child-resistant screw-on closure is intended for use on containers having a threaded portion which is threadedly engagable with the screw-on closure.

Specifically, the child-resistant screw-on closure is provided with both an inner cap and an outer cap. The inner cap is provided with a top portion and a cylindrical skirt depending from the top portion. The cylindrical skirt has an outer and inner surface, with the inner surface of the skirt being threaded for threaded engagement with the container when the inner cap is rotated in one direction. Likewise, the inner surface of the skirt of the inner cap is disengageable from the container when the inner cap is rotated in an opposite direction. The outer cap is provided with a top and a cylindrical skirt coaxial with and surrounding the skirt of the inner cap. The cylindrical skirt has an outer and inner surface with the inner and outer caps being in close confronting relation as well as being axially moveable relative to one another.

The inner surface of the skirt of the outer cap has a plurality of knurlings extending away from the top in an angular direction. The outer surface of the skirt of the inner cap is provided with a radial shoulder spaced dependingly downward from the top. This radial shoulder extends outwardly from the skirt of the inner cap and is provided with a plurality of triangular saw tooth projections. The triangular saw tooth projections are complimentary to the plurality of knurlings so that when the outer cap is turned in one direction, the plurality of knurlings and the plurality of triangular saw tooth projections will meet to cam the outer cap relative to the inner cap to rotate the inner cap in one direction thereby threadedly engaging the inner cap on the container. When the outer cap is rotated in an opposite direction, the plurality of knurlings will ratchet over the plurality of triangular saw tooth projections thereby preventing the rotation of the inner cap in the opposite direction to open the container. However, by applying an axial force to the outer cap toward the inner cap, this enables the outer cap to impart rotation to the inner cap in the opposite direction, so that the ratcheting of the outer cap axially away from the inner cap is thereby prevented.

The outer cap is preferably further provided with a guide ring located on the inner skirt surface of the outer cap. This guide ring depends downwardly from the top and axially aligns the inner cap to the outer cap.

In reference to the plurality of triangular saw tooth projections, each of these projections further includes a sloped first surface and a substantially vertical second surface. The sloped first surface and the substantially vertical second surface meet to define therebetween an angle in the range of about 30° to 60°. In a preferred embodiment, the angle between the sloped first surface and the substantially vertical second surface is about 45°. As well, the outer cap that is mentioned above, is provided with a plurality of knurlings. Accordingly, the vertical axis of the outer cap and the plurality of knurlings define therebetween an angle in the range of about 30° to 60°. In a preferred embodiment, the angle between the vertical axis and the plurality of knurlings is about 50°.

Thus, in accordance with the invention, a novel child-resistant closure having an inner and outer cap as well as a radially extending shoulder which extends outwardly from the skirt of the inner cap which is provided with a plurality of triangular saw toothed projections complementary to the plurality of knurlings is provided. As such, a child-resistant screw-on closure, which requires less torque than conventional child-resistant closures for the removal of the closure device while still retaining the child-resistant safety feature, is provided.

Other objects and features of .the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

DETAILED DESCRIPTION OF THE DRAWINGS

In the drawings, wherein like reference numerals identify similar elements throughout the several views.

DETAILED DESCRIPTION OF THE PRESENTLY PREFERRED EMBODIMENTS

A child-resistant closure provided in accordance with the present invention which includes an inner cap and an outer cap with the outer cap arranged for rotation relative to the inner cap is provided. The inner cap has a circular top portion, a cylindrical skirt depending downward from the top, and a plurality of saw toothed projections located on the outer surface of the inner cap. The outer cap has a circular top portion, a cylindrical skirt coaxial with and peripherally surrounding the skirt of the inner cap, and a plurality of angularly extending knurlings located on the inner skirt surface of the outer cap. When axial force is applied to the outer cap toward the inner cap for the purpose of removing the closure, the knurlings of the outer cap cam with the saw toothed projections of the inner cap engaging the caps so that they rotate as a unit and disengage from the container. Additionally, the outer cap has a guide for keeping the inner cap concentric with the outer cap.

Figure 1:
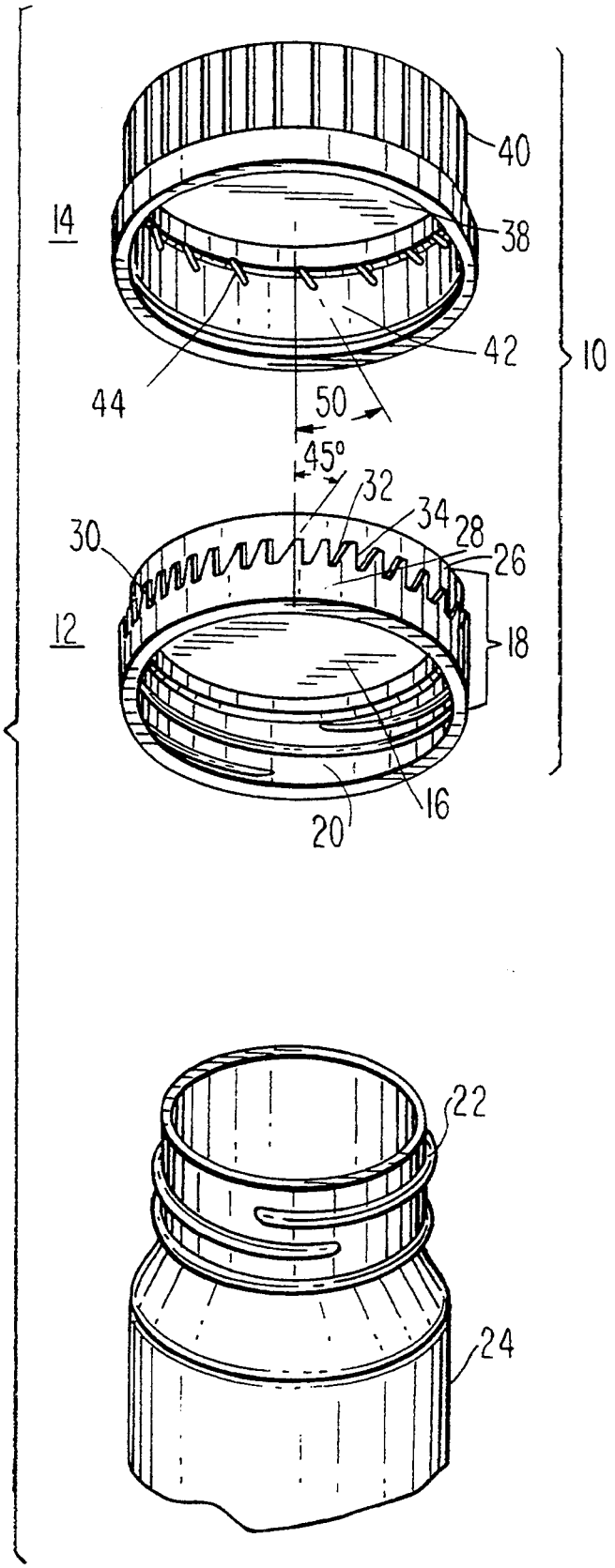
FIG. 1 is an exploded elevated perspective view of an child-resistant closure and a bottle constructed and arranged in accordance with the invention.
Figure 2:
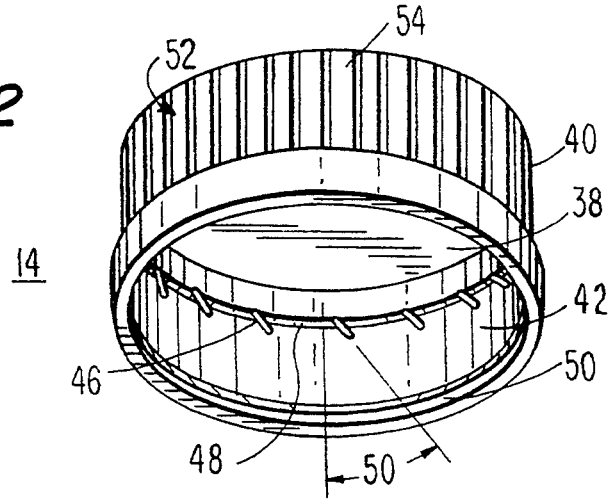
FIG. 2 is a perspective view of the outer cap of the child-resistant closure of FIG. 1.
Figure 3:
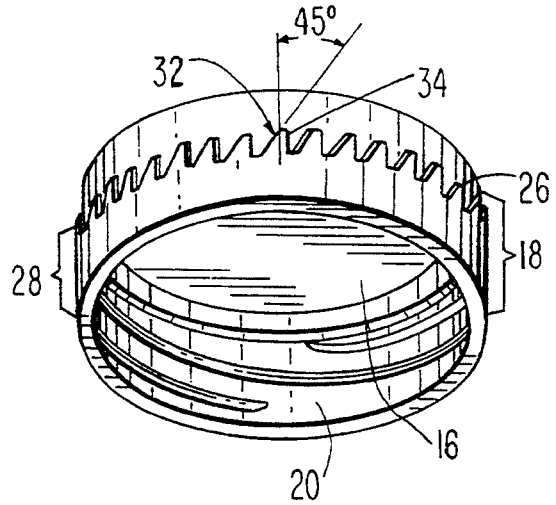
FIG. 3 is a perspective view of the inner cap of the child-resistant closure of FIG. 1.

Referring specifically to FIGS. 1, 2 and 3 of the drawings, a child-resistant closure 10 is constructed and arranged in accordance with the invention. Closure 10 includes an inner cap 12 and an outer cap 14 which are in axial alignment and in close confronting relation with each other. The inner cap 12 has a circular top wall portion 16 and a cylindrical skirt 18 depending from the top wall portion 16. The inner surface of the skirt 20, as shown in FIG. 1, is threaded for threaded engagement with a conventional threaded portion 22 of a container 24 when the inner cap 12 is rotated in a closing direction, here shown by way of example to be clockwise. The inner cap 12 is disengageable from the threaded portion 22 of the container 24 when rotated in an opening direction, here, e.g., counterclockwise. The outer surface 26 of the cylindrical skirt of the inner cap 12 is provided with a radial shoulder 28 spaced dependingly downward from the circular top wall portion 16 and extending outwardly from skirt 18.

Figure 5:
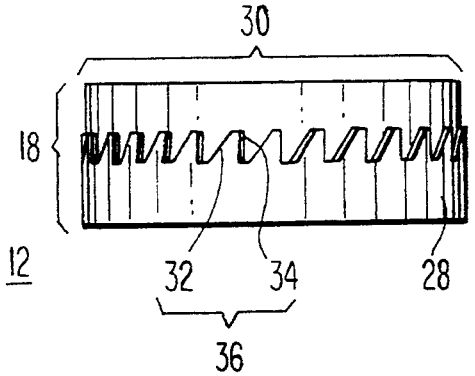
FIG. 5 is a cross-sectional side view of the inner cap of FIG. 3.

Referring to FIG. 5, the radial shoulder 28 has a plurality of angular extending triangular saw toothed projections 30, each projection having a sloped first surface 32 and a substantially vertical second surface 34. The sloped first surface 32 and the substantially vertical second surface define therebetween an angle ranging from about 30° to about 60°, which is contemplated as most typically being about 45°. The plurality of saw toothed projections as shown in the embodiment in FIG. 5 comprises thirty-two (32) individual triangular teeth 36.

Figure 4:
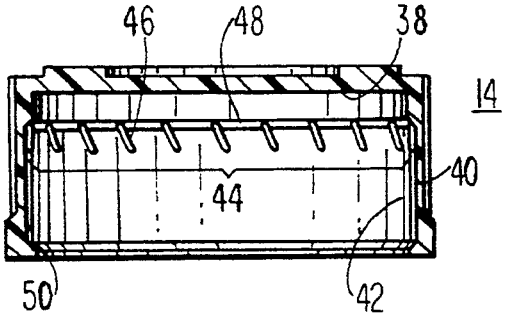
FIG. 4 is a cross-sectional side view of the outer cap of FIG. 2.

The outer cap 14 has a circular top wall portion 38 and a cylindrical skirt 40 coaxial with and peripherally surrounding the cylindrical skirt portion 18 of the inner cap 12. As shown in FIGS. 1, 2 and 4, the inner surface 42 of the skirt 40 of the outer cap 14 has a plurality of angularly extending knurlings 44 comprising individual drive knurls 46. The embodiment shown in FIG. 4 has sixteen (16) such drive knurls 46, with the ratio of triangular teeth 36 to the drive knurls 46 being 2:1. However, any ratio of triangular teeth 36 to drive knurls 46 such as 1:1, 3:1 etc. may be used.

The angularly extending knurlings 44 are complementary to and angled the same way as the angularly extended triangular saw toothed projections 30 located on the radial shoulder 28 of the inner cap 12. Indeed, similar to the angle defined by surfaces 32 and 34 of projections 30, the angle defined between the knurlings 44 and a vertical axis defined by the outer cap 14 is in the range of about 30° to about 60°. The angle of the embodiment shown in FIG. 2 is about 50°. Thus, when the outer cap 14 is rotated in the opening direction, the knurlings 44 will ratchet or ride up over the vertical second surface of the saw toothed projections 30, thereby preventing rotation of the inner cap 12. This can be overcome only by the simultaneous application of a turning force and an axial force on the outer cap 14 toward the inner cap 12 to enable the outer cap 14 to impart rotation to the inner cap 12 so that the two rotate in unison.

Referring to FIGS. 2 and 4, the outer cap 14 also includes a guide ring 48 located on the inner skirt surface 42 of the outer cap 14. The guide ring 48, which depends downwardly from the circular top portion 38, axially aligns the inner cap 12 to the outer cap 14.

The outer cap 14 further comprises, distal to the circular top 38, an inwardly extending lip portion 50 on the inner surface 42 of skirt 40 for retaining the inner cap 12 and for permitting the inner cap 12 and the outer cap 14 to be in close confronting relation to each other. The outer cap 14 also comprises a means 52 for gripping the outer cap 14, the means including a plurality of substantially vertical grooves 54 positioned on skirt 40 of outer cap 14.

In order to utilize the child-resistant closure in accordance with the invention and referring to FIG. 1, the closure 10 is first placed on the threaded portion 22 of the container 24. A rotative force is used to turn the outer cap 14 in the closing, i.e., clockwise direction. The complementary knurlings 44 and saw tooth projections 30 on the outer and inner caps 14, 12 cause the inner cap 12 to remain stationary relative to the outer cap 14. Thus, as the user closes the container, the rotative force provides a seal between the threaded portion 22 of the container 24 and the threaded portion 20 of inner cap 12.

In order to open the sealed container 24, the user must utilize both a rotative and an axial force. It is the axial force that prevents the knurlings 44 of the outer cap from ratcheting of riding up over the saw toothed projections 30 of the inner cap. Thus, when the outer cap 14 is rotated in an opening, here counterclockwise, direction, with the use of both rotational and axial force, the knurlings 44 of the outer cap 14 cam with the substantially vertical second surface 34 of the saw toothed projections 30 of the inner cap, thus engaging the caps 14, 12 so that they rotate in unison. This allows the threaded portion 20 of the inner cap 12 to disengage from the threaded portion 22 of the container 24. Accordingly, the closure 10 is disengaged from the container 24.

It is to be understood that the child-resistant closure device provided in accordance with the present invention can be formed of any suitable material such as plastic or metal or a combination of materials and the like and that the invention is not intended to be limited by the material from which the devices are formed.

These and other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

What is claimed is:

1. A child resistant screw-on closure for use on a container having a threaded portion threadedly engageable with said screw-on closure, comprising:

an inner cap defining a vertical axis and comprising a top and a cylindrical skirt depending from said top and annularly surrounding said vertical axis, said cylindrical skirt having an outer and an inner surface, the inner surface of said skirt being threaded for threaded engagement with the container when said inner cap is rotated in one direction and is disengageable therefrom when said inner cap is rotated in an opposite direction;

an outer cap comprising a top and a cylindrical skirt coaxial with and surrounding the skirt of said inner cap, said cylindrical skirt having an outer and inner surface, said inner and outer caps being in close confronting relation and being axially moveable relative to one another;

the inner surface of said skirt of said outer cap having a plurality of knurlings extending away from the top thereof in an angular direction, extending axially and in said one direction; and said skirt of said inner cap having a portion adjacent said top of a given thickness and another portion adjacent said first portion that protrudes radially outwardly from said first portion to define a thicker portion, the radial shoulder between said two portions defining a plurality of triangular saw toothed projections complimentary to said plurality of knurlings, each of said plurality of triangular saw toothed projections further comprising a sloped first surface and a second surface, said sloped first surface sloping at an angle to the vertical axis in the range of about 30° to 60°, said second surfaces providing an abutment for said knurlings so that when said outer cap is turned in said one direction, said plurality of knurlings and said plurality of triangular saw toothed projections will engage to rotate said inner cap in said one direction to threadedly engage said inner cap on said container, and when said outer cap is rotated in an opposite direction, said plurality of knurlings will be cammed by said plurality of triangular saw toothed projections to disengage said inner and outer caps to prevent the rotation of said inner cap in said opposite direction to open said container, said camming being preventable by applying an axial force to said outer cap toward said inner cap to enable said outer cap to impart rotation to said inner cap in said opposite direction.

2. The child resistant screw-on closure of claim 1, wherein said outer cap further includes a guide ring on said inner skirt surface of said outer cap depending downward from said top for axially aligning the inner cap to the other cap.

3. The child resistant screw-on closure of claim 1, wherein said angle is about 45°.

4. The child resistant screw-on closure of claim 1, wherein said outer cap defines a vertical axis and wherein said plurality of knurlings and said vertical axis define therebetween an angle in the range of about 30° to about 60°.

5. The child resistant screw-on closure of claim 4, wherein said angle is about 50°.

6. The child resistant screw-on closure of claim 1, wherein said outer cap further comprises an inwardly extending lip portion on said inner surface of said cylindrical skirt and distal to said top of said outer cap for retaining said inner cap and for permitting said inner and outer caps to be in close confronting relation.

7. The child resistant screw-on closure of claim 1, wherein said plurality of triangular saw toothed projections comprise 32 individual triangular teeth.

8. The child resistant screw-on closure of claim 1, wherein said plurality of knurlings comprise 16 individual drive knurls.

9. The child resistant screw-on closure of claim 1, wherein the ratio of said triangular teeth to said drive knurls is 2 to 1.

10. The child resistant screw-on closure of claim 1, wherein the inner cap is formed of a plastic material.

11. The child resistant screw-on closure of claim 1, wherein said outer cap is formed of a plastic material.

12. The child resistant screw-on closure of claim 1, wherein said outer cap further comprises a means for gripping said outer cap.

13. The child resistant screw-on closure of claim 12, wherein said means for gripping said outer cap includes a plurality of substantially vertical grooves positioned on said outer cylindrical skirt of said outer cap.

14. A child resistant screw-on closure for use on a container having a threaded portion threadedly engageable with said screw-on closure, comprising:

an inner cap defining a vertical axis and comprising a top and a cylindrical skirt depending from said top and annularly surrounding said vertical axis, said cylindrical skirt having an outer and an inner surface, the inner surface of said skirt being threaded for threaded engagement with the container when said inner cap is rotated in one direction and is disengageable therefrom when said inner cap is rotated in an opposite direction;

an outer cap defining a vertical axis and comprising a top and a cylindrical skirt coaxial with and surrounding the skirt of said inner cap, said cylindrical skirt having an outer and inner surface, said inner and outer caps being in close confronting relation and being axially moveable relative to one another;

the inner surface of said skirt of said outer cap having a plurality of knurlings extending away from the top thereof in an angular direction, extending axially and in said one direction, said plurality of knurlings and said vertical axis defining an angle therebetween of about 50°; and said skirt of said inner cap having a portion adjacent said top of a given thickness and another portion adjacent said first portion that protrudes radially outwardly from said first portion to define a thicker portion, the radial shoulder between said two portions defining a plurality of triangular saw toothed projections complimentary to said plurality of knurlings, each of said plurality of triangular saw toothed projections further comprising a sloped first surface and a second surface, said sloped first surface sloping at an angle to the vertical axis of about 45°, said second surface providing an abutment for said knurlings so that when said outer cap is turned in said one direction, said plurality of knurlings and said plurality of triangular saw toothed projections will engage to rotate said inner cap in said one direction to threadedly engage said inner cap on said container, and when said outer cap is rotated in an opposite direction, said plurality of knurlings will be cammed by said plurality of triangular saw toothed projections to disengage said inner and outer caps to prevent the rotation of said inner cap in said opposite direction to open said container, said camming being preventable by applying an axial force to said outer cap toward said inner cap to enable said outer cap to impart rotation to said inner cap in said opposite direction.

15. The child resistant screw-on closure of claim 14, wherein said outer cap further comprises an inwardly extending lip portion on said inner surface of said cylindrical skirt and distal to said top of said outer cap for retaining said inner cap and for permitting said inner and outer caps to be in close confronting relation.

16. The child resistant screw-on closure of claim 14, wherein said plurality of triangular saw toothed projections comprise 32 individual triangular teeth.

17. The child resistant screw-on closure of claim 14, wherein said plurality of knurlings comprise 16 individual drive knurls.

18. The child resistant screw-on closure of claim 14, wherein the ratio of said triangular teeth to said drive knurls is 2 to 1.

* * * * *

US005370251C1

(12) EX PARTE REEXAMINATION CERTIFICATE (8547th)

United States Patent
Buono

(10) Number: US 5,370,251 C1
(45) Certificate Issued: Sep. 20, 2011

(54) CHILD-RESISTANT CLOSURE

(75) Inventor: Caetano Buono, Staten Island, NY (US)

(73) Assignee: Van Blarcom Closures, Inc., Brooklyn, NY (US)

Reexamination Request:
No. 90/011,601, Mar. 25, 2011

Reexamination Certificate for:

| | |
|---|---|
| Patent No.: | **5,370,251** |
| Issued: | **Dec. 6, 1994** |
| Appl. No.: | **08/096,036** |
| Filed: | **Jul. 22, 1993** |

(51) Int. Cl.
*B65D 50/02* (2006.01)
*B65D 55/02* (2006.01)

(52) U.S. Cl. ..... 215/220; 215/230
(58) Field of Classification Search ..... None See application file for complete search history.

(56) References Cited

U.S. PATENT DOCUMENTS

| | | | |
|---|---|---|---|
| 4,241,840 | A | 12/1980 | Willis |
| 4,364,484 | A | 12/1982 | Kinsley |
| 5,092,477 | A | 3/1992 | Johnson, Jr. et al. |

*Primary Examiner*—Jeanne M Clark

(57) ABSTRACT

An child-resistant closure for bottles and similar containers is provided. The child-resistant closure is provided with an inner cap which has a plurality of triangular saw tooth projections located on its outer surface and an outer cap which fits over and rotates relative to the inner cap and is provided with knurlings located on its inner surface. The knurlings of the outer cap are complementary to and angled the same way as the saw tooth projections of the inner cap so that when the outer cap is rotated in the opening direction, the knurlings will move freely or ratchet over the saw tooth projections. However, when axial force is applied to the outer cap toward the inner cap, the knurlings cam against the saw toothed projections causing the caps to rotate in unison and disengage from the container. Additionally, this child-resistant closure utilizes a guide on the inner surface of the outer cap to keep the inner cap in alignment with the outer cap.

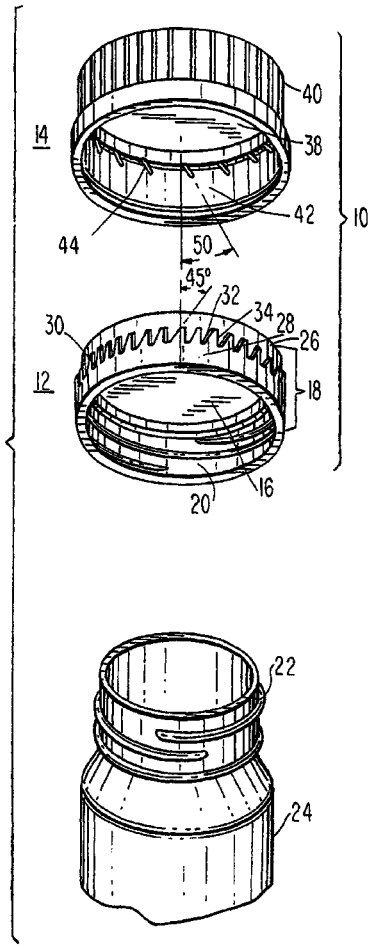

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-18 is confirmed.

* * * * *